US007063747B2

(12) United States Patent
Lastowka

(10) Patent No.: US 7,063,747 B2
(45) Date of Patent: Jun. 20, 2006

(54) COATING CONTROL SYSTEM FOR USE ON A SPHERICAL OBJECT

(75) Inventor: Eric J. Lastowka, Hanover, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/156,178

(22) Filed: May 29, 2002

(65) Prior Publication Data

US 2003/0221615 A1 Dec. 4, 2003

(51) Int. Cl.
*B05C 11/10* (2006.01)

(52) U.S. Cl. ..... 118/669; 118/680; 118/679; 118/713

(58) Field of Classification Search ..... 118/669, 118/676, 679, 682, 683, 684, 685, 686, 687, 118/713, 313, 316
See application file for complete search history.

(56) References Cited

U.S. PATENT DOCUMENTS

| | | | | |
|---|---|---|---|---|
| 4,444,495 A | | 4/1984 | Bramwell et al. | 356/138 |
| 4,831,561 A | * | 5/1989 | Utsumi | 702/150 |
| 5,060,594 A | | 10/1991 | Tomioka et al. | 118/666 |
| 5,429,682 A | * | 7/1995 | Harlow, Jr. et al. | 118/681 |
| 5,564,830 A | | 10/1996 | Bobel et al. | 374/126 |
| 5,759,641 A | | 6/1998 | Dimitrienko et al. | 427/556 |
| 5,857,625 A | | 1/1999 | Klein et al. | 239/289 |
| 5,868,840 A | | 2/1999 | Klein, II et al. | 118/300 |
| 5,951,296 A | | 9/1999 | Klein | 434/84 |
| 5,968,297 A | * | 10/1999 | Hooker et al. | 156/64 |
| 5,993,681 A | | 11/1999 | Glogovsky | 216/85 |
| 6,001,177 A | * | 12/1999 | Gendreau et al. | 118/300 |
| 6,225,621 B1 | * | 5/2001 | Rogers et al. | 250/221 |
| 6,532,066 B1 | * | 3/2003 | Filev et al. | 356/237.2 |

FOREIGN PATENT DOCUMENTS

| | | |
|---|---|---|
| CA | 1 205 545 | 6/1996 |
| DE | 28 50 421 | 11/1978 |
| EP | 0846498 | 6/1998 |

OTHER PUBLICATIONS

Garwood, Bod, Dec. 1999, Sensors Magazine, Advantstar Communications, vol. 16, No. 12, pp. 1-10 (computer print-out).*

* cited by examiner

*Primary Examiner*—George Koch
(74) *Attorney, Agent, or Firm*—Bingham McCutchen LLP

(57) ABSTRACT

A coating control system and method for monitoring and potentially adjusting system at least one spray property at various stages of the painting process, thereby also providing an efficient set-up and monitoring process involving less manual labor, less waste, and less harmful exhaust to the atmosphere, wherein the coating control system includes at least one spray gun, at least one light emitting source and at least one receiver.

32 Claims, 10 Drawing Sheets

COATING CONTROL SYSTEM FOR USE ON A SPHERICAL OBJECT

TECHNICAL FIELD OF THE INVENTION

The present invention relates to coating systems, and more particularly, relates to an improved coating control system for use in coating a golf ball or other spherical object. In particular, the present invention is directed to a coating control system providing a method to monitor and potentially adjust system at least one spray parameter at selected stages of the painting process for use with a spherical object. The present invention is also directed to a method of monitoring painting or coating on a golf ball with efficient set-up and in-line monitoring involving less manual labor, less waste, and less harmful exhaust to the atmosphere.

BACKGROUND OF THE INVENTION

Conventional golf balls generally include a core surrounded by a cover. The cover forms a spherical outer surface of the ball and the surface includes a plurality of dimples. The core and/or the cover can be formed of a plurality of layers and the core can include a solid or fluid-filled center surrounded by windings and/or molded material. The covers of presently available golf balls are typically formed from a variety of materials such as balata, polyurethane and ionomer resins such as SURLYN® and IOTEK®, depending upon the desired performance characteristics of the golf ball and desired properties of the cover.

Golf balls are provided in a variety of colors. Conventionally they are white, but they may be manufactured with essentially any desired color. The color is imparted either by layers of paint applied to the outer surface of the ball or by incorporating a pigment directly into the cover composition. Typically, in a painted ball, a first coat or primer layer of paint is applied, followed by a second, i.e., finishing coat or layer. After a ball has been colored, identifying indicia such as a trademark, logo, identification number, model name and/or number, and the like can be stamped or printed onto the ball.

It is important that golf balls be capable of withstanding a variety of weather conditions such as sunlight, extreme temperature ranges, and immersion in water, preferably for an extended period. Further, the surface of a golf ball is flexed every time it is impacted with a club and, consequently, it must be able to withstand repeated stresses without damage to the cover. There are multiple sources of other types of degradation to the ball, for example, being struck with a grooved club head or landing on a rocky or abrasive surface such as a cart path. Resistance to such impact and abrasion is an important feature of a golf ball.

It is further desirable for golf ball manufacturers that their golf balls be resistant to delamination or chipping of the paint layers, as aesthetic defects tend to negatively impact the public perception of golf ball quality. Likewise, golf ball manufacturers prefer to protect trademarks, logos or other identifying indicia which identifies the brand of the ball to the playing public.

Golf balls are, therefore, generally subjected to at least one clear or pigmented top coat, primer coat, or other protective coat, which covers the golf ball outer surface in order to improve the overall appearance of the ball, e.g., high-gloss surface. In addition, a top coat helps to protect any painted or primed layers and/or printed patterns thereon from degradation during the golf ball's normal useful life. Such coatings can be applied as a single layer or as a multiple layers.

Paint layers or protective coating materials can be applied by various methods. One such method uses a coating gun to spray the paint or coating material as atomized particles. In this method, an operator must visually observe the spray as a ball is coated, determine whether the spray adequately coats the ball, and then manually change the orientation or location of the gun, as necessary. As a result, a number of balls may be improperly coated during set-up, which leads to increased manufacturing costs due to wasted materials. In addition, an operator must shut down the line to make routine measurements, e.g., spray volume per pulse, and adjust if necessary, which leads to production inefficiencies due to line downtime on the line.

Furthermore, water-based coatings, in general, while desirable due to the low toxicity of the solvent, are much harder to evaporate than volatile organic materials, and therefore, are energy intensive, requiring expensive drying ovens to remove the water.

Moreover, coatings and inks used in spraying and pad printing techniques typically involve volatile organic compounds (VOC) found in the compounds used. Manufacturers of printed products may be strongly affected by federal and local regulations that impose restrictions on the emission of VOCs, such as methyl ethyl ketone, acetone, toluene, alcohols, and chlorinated solvents, to the atmosphere.

No system or method is presently known in the golf ball industry for monitoring various spray system properties before, during, and/or after painting. Thus, there remains a need for an automatic coating control system capable of monitoring and adjusting spray properties of the system at various stages of the process for three-dimensional objects, in particular, golf balls.

SUMMARY OF THE INVENTION

The present invention is directed to a coating control system for use on a golf ball with a golf ball location, including a coating gun for emitting a spray; a light source for identifying a spray location; a tracking device for identifying a golf ball position; and an adjuster operatively connected to the light emitting source such that the golf ball location and the spray location can be substantially synchronized. The golf ball moves may move from the first position to the second position during operation of the system.

In one embodiment, the light source emits a beam of light representing the spray. The light source may be disposed at a first position and the coating gun is disposed at a second position downstream of the first position.

In another embodiment, the coating control system includes at least two light sources, the first light source being upstream of the coating gun and the second light source being downstream of the coating gun, and the first and second light sources are laser beam emitters and receivers. Preferably each light source emits a light beam toward the ball that is reflected back to the associated light source causing the light source to generate an analog signal indicative of at least one spray property. The light sources may be operatively connected to the adjuster and the adjuster coupled to the gun, wherein the adjuster uses each analog signal to control the spray emitted by the gun. In one embodiment, the adjuster is automatic.

In yet another embodiment, the light source is located above the gun such that a light beam emitted from the light source illuminates the spray to make the spray location visible.

In one embodiment, the light source includes a laser or a led light source. In another embodiment, the coating control system further includes at least two coating guns and at least one light source associated with each gun.

The present invention is also directed to a coating control system including a device for emitting a coating spray; a light source for identifying a spray property; and an adjuster operatively connected to the device such that the coating spray property can be adjusted. In one embodiment, the device is at least one coating gun.

The adjustable coating spray property is preferably at least one of a coating spray density, an atomization parameter, a coating spray pattern, a coating spray distribution, a coating spray thickness, or polarity. In one embodiment, the atomization parameter includes spray particle size.

In one embodiment, the coating control system includes a light source that emits a light beam that intersects the coating spray. In another embodiment, the light source is a laser beam emitter. The coating control system preferably includes a laser beam receiver spaced from the laser beam emitter for receiving the laser beam after the beam intersects the coating spray. In yet another embodiment, the laser beam receiver is in fluid communication with the adjuster, and wherein the adjuster receives at least one signal from the receiver indicative of at least one coating spray property.

The coating control system preferably further includes focusing optics disposed between the laser beam emitter and the laser beam receiver. In one embodiment, the laser beam emitter is a polarized beam emitter and the emitter and the receiver are positioned such that the light beam received by the receiver is linearly polarized.

In another embodiment, the laser beam emitter is positioned above the golf ball and a receiver is positioned above the golf ball to receive the laser beam from the emitter.

In one embodiment, the coating control system of the invention includes a microprocessor in fluid communication with the adjuster and the light source. In another embodiment, the coating control system of the invention is controlled such that the light source and the device are in an operative mode at the same time.

The present invention is also directed to a coating control system for use on a spherical object including a coating gun for selectively emitting a spray in a first pattern and a light source for emitting light in a second pattern, wherein the first and second patterns are substantially the same and contact the spherical object.

In one embodiment, the emission of the spray and the light occur simultaneously. In another embodiment, the emitted light is a laser beam received by a receiver, wherein the receiver generates a signal indicative of the second pattern.

In yet another embodiment, the coating control system further includes an adjuster in fluid communication with the coating gun and light source, wherein the adjuster alters the first pattern to be substantially the same as the second pattern.

In one embodiment, the coating control system is controlled such that the emission of the light occurs prior to the emission of the spray. In this embodiment, the emitted light is preferably a laser beam received by a receiver, wherein the receiver generates a signal indicative of the second pattern. In another embodiment, the coating control system further includes an adjuster in fluid communication with the coating gun and light source, wherein the adjuster alters the first pattern to be substantially the same as the second pattern.

BRIEF DESCRIPTION OF THE DRAWINGS

To facilitate the understanding of the characteristics of the invention, the following drawings have been provided wherein.

DETAILED DESCRIPTION OF THE INVENTION

The present invention is directed to a coating control system advantageously providing a method to monitor and potentially adjust system properties at various stages of the painting process, thereby also providing an efficient set-up and monitoring process involving less manual labor, less waste, and less harmful exhaust to the atmosphere. The present invention is also directed to a method for automatically monitoring the exhaust for painting processes for reporting to the Environmental Protection Authority (EPA). As used herein, "painting process" can include the application of any primer, intermediate, or finish layer of paint, protective coating, or decorative coating.

The coating control system of the invention includes at least one gun, at least one light source, a conveyor for article transport, and, optionally, an adjuster to alter at least one selected spray system property. Spray properties monitored include, but are not limited to, location, pattern, thickness, coverage or distribution, volume per pulse, particle size, and polarity. Conveyor properties that may optionally be adjusted in response to a misaligned system parameters include, but are not limited to, conveyor speed or the rate of ball spin on the spindles. Environmental conditions of the system may be also monitored, e.g., exhaust, for routine reporting, adjustments to the systems, or a combination thereof. The coating control system may monitor and optionally, automatically adjust the various properties before, during, and/or after painting, using different arrangements of the light sources in respect to the spray guns.

Figure 1:
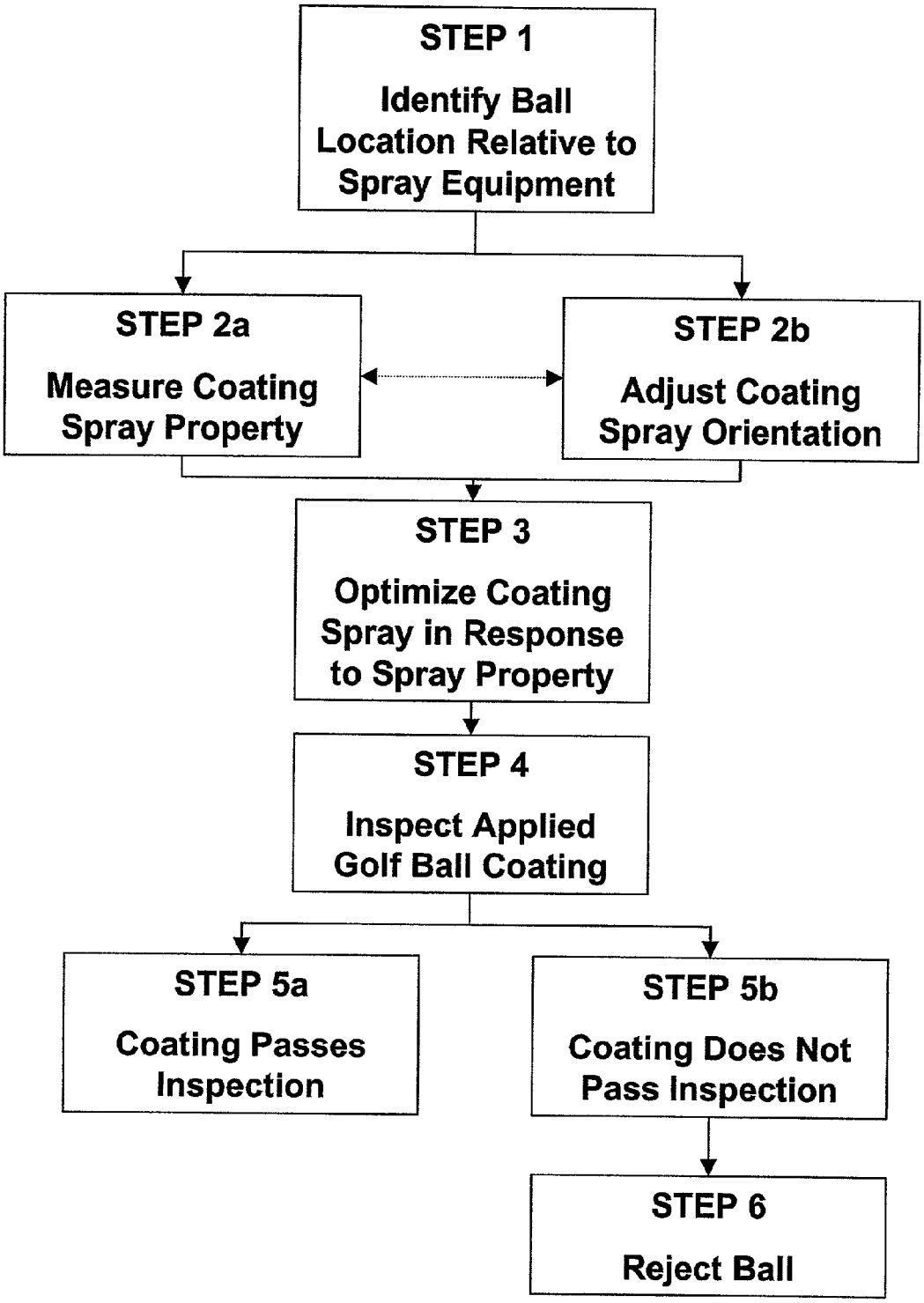
FIG. 1 is a flow chart illustrating the general steps that may be undertaken when using a coating system of the present invention.

FIG. 1 shows the general steps that may be undertaken when using the painting process of the present invention. Step 1 generally includes a first assessment of the ball position in the painting process relative to the spray equipment. Steps 2*a* and 2*b* may be performed in any order. For example, Step 2*a* may involve inspecting the spray pattern as it leaves the gun for potential coverage on the ball or it may involve an assessment of the density of the cloud leaving the gun to determine potential thickness of the coating on the bath On the other hand, Step 2*b* may be used to adjust the position of the guns or nozzle settings prior to spraying paint based on the position of the ball relative to the spray equipment Step 2*a* and Step 2*b* may also be taken consecutively. For example, once a coating spray property is assessed, at least one coating spray orientation may be adjusted accordingly, or once a coating spray orientation is adjusted, the coating spray property is measured. While measured properties discussed herein are generally described as physical properties of the spray, other properties such as humidity in the painting process booth, air flow through the booth, and temperature of the booth may also be measured and the coating spray may be adjusted accordingly.

Step 3 involves optimization of coating spray properties. This may be accomplished through a repetitive process feedback loop using Steps 2*a* and 2*b*. These steps may be used back to back, again and again, until the correct spray orientation is achieved.

One a ball is sprayed with the spray equipment, the coating may be inspected using steps similar to Steps 2*a* and 2*b*. Steps 5*a* and 5*b* determine whether the coating is acceptable. Step 6 rejects a golf ball having an unacceptable coating layer. A diverter may be used to send reject balls to one location and send acceptable balls for further processing.

Figure 2:
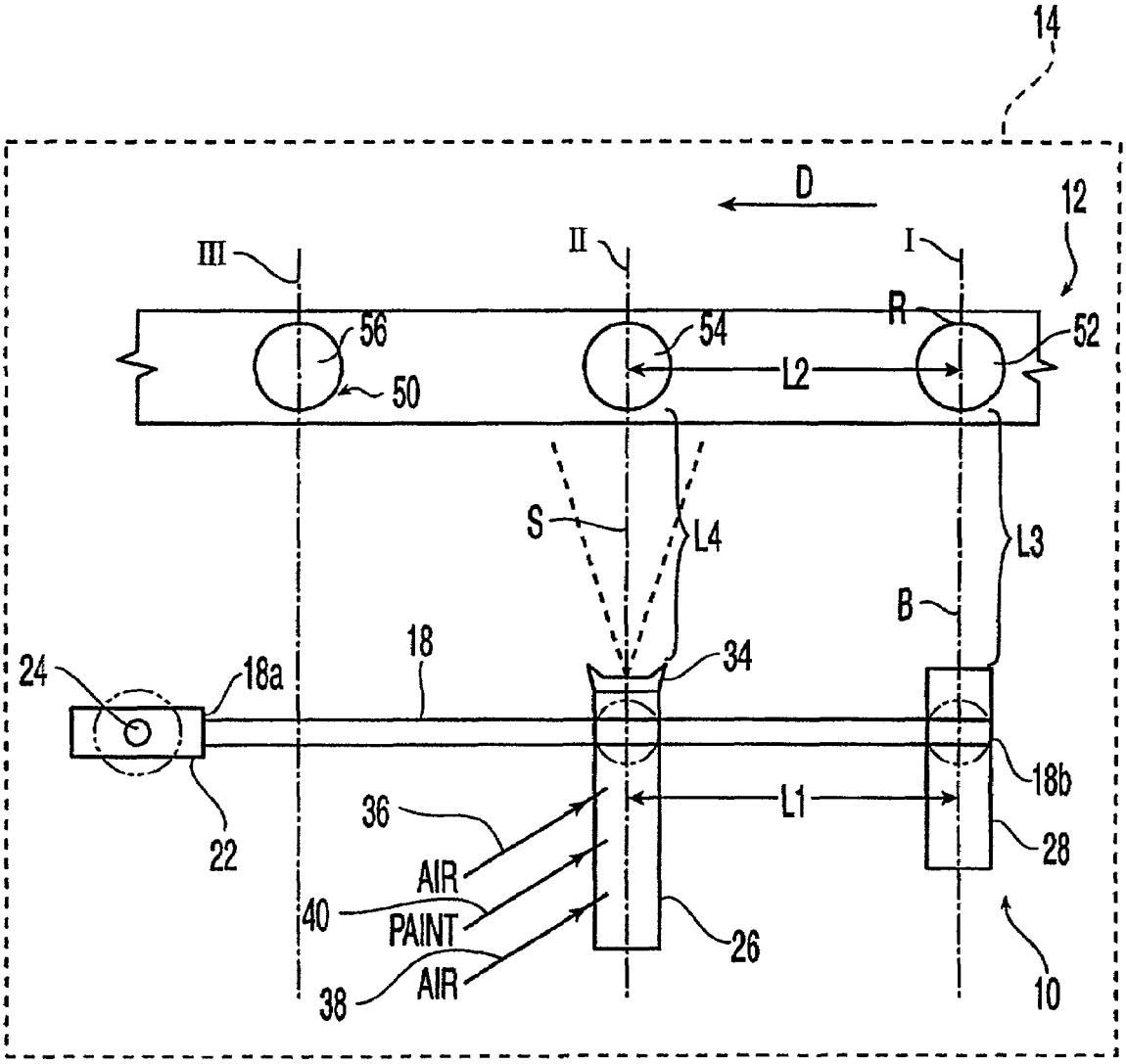
FIG. 2 is a schematic, top view of an embodiment of a coating control system of the present invention, showing golf balls in various positions during operation.
Figure 3:
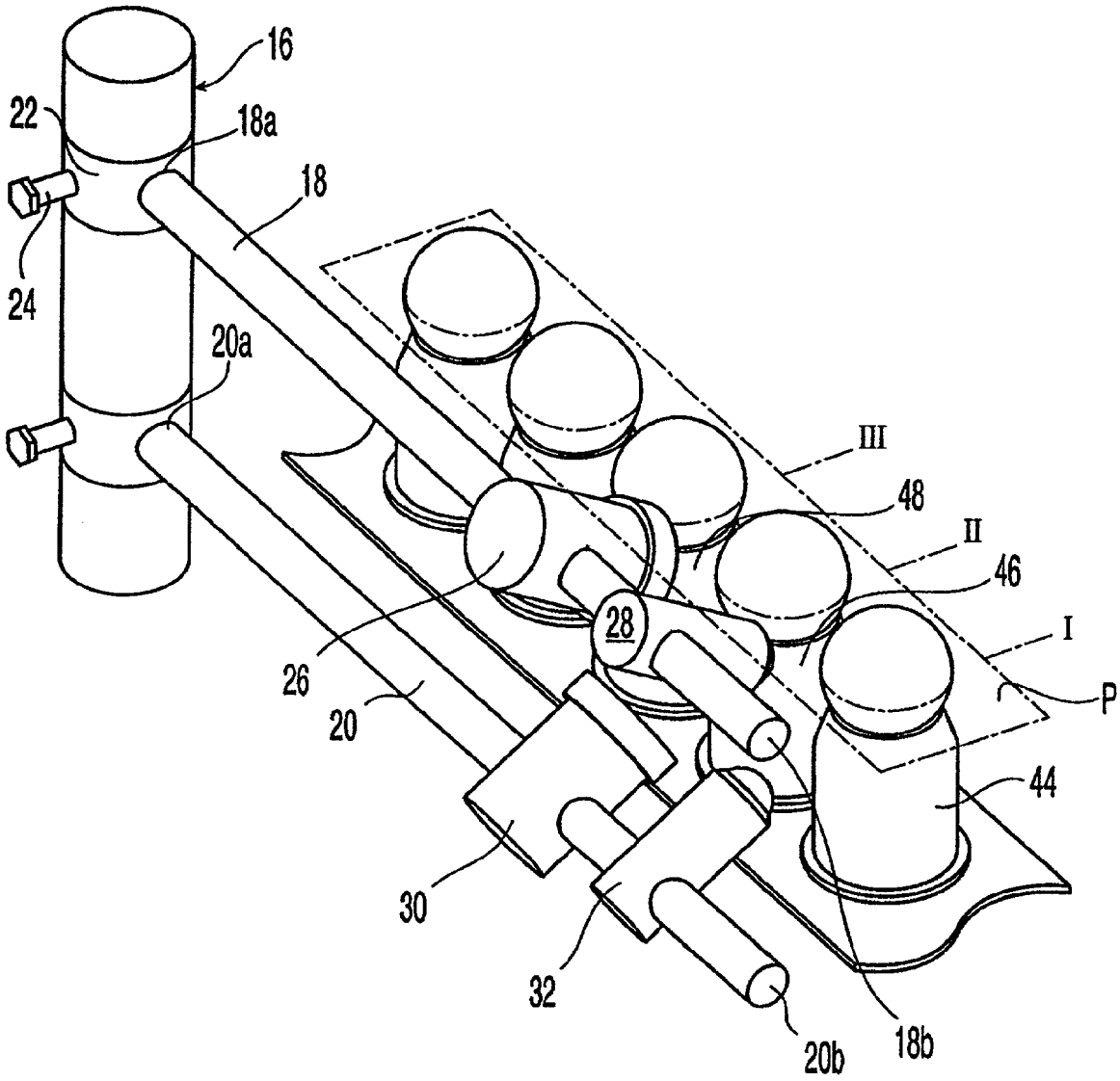
FIG. 3 is a schematic, perspective view of the embodiment of the coating control system of FIG. 2.

The coating control system may include one gun and one lighting source, or alternatively, multiple guns and light sources. FIGS. 2 and 3 depict a general arrangement of the coating control system of the invention using two guns and two light sources. For purposes of illustrating the present invention, the figures and associated description show the ball at various stages of the painting process, e.g., Stage 1 , Stage 2, and Stage 3 . For example, Stage 1 generally corresponds to the ball position upstream of the gun(s) before painting. The ball is lined up with the gun(s) at Stage 2 . Stage 3 corresponds with ball movement downstream of the gun(s) after painting.

The coating control system 10, including a golf ball conveyor 12, is shown within a paint booth 14 (shown in broken lines). The coating control system 10 may include a vertical mount pole 16 and a pair of mounting members 18, 20 each with first ends 18*a*, 20*a*, respectively, and second ends 18*b*, 20*b*, respectively. Each mounting member 18, 20 may be coupled to the pole 16 at the first end 18*a*, 20*a* with a conventional clamp 22 and fastener 24. Each mounting member 18, 20 may be secured to the pole 16 so that each mounting member 18, 20 extends substantially horizontally from the pole 16 and can vertically slide along the length of the pole 16 to adjust its height in relation to the ball conveyor 12. The ball conveyor 12 includes a horizontal ball plane P that extends through the equator of the ball.

A first or top coating gun 26 may be supported by the mounting member 18 between the ends 18*a* and 18*b* and a first or top light emitting source 28 may be mounted, i.e., mechanically bolted, to the free end 18*b* of the mounting member 18. In addition, the coating control system 10 may further include a second or bottom coating gun 30 supported by the mounting member 20 between the ends 20*a* and 20*b* and a second or bottom light emitting source 32 may be mounted to the free end 20*b* of the mounting member 20. Each of the light emitting sources 28 and 32 may be mounted to be substantially parallel to their respective guns 26 and 30.

Each coating gun 26, 30 generally includes a flow nozzle 34 at the free end, a paint pressure air supply line 36, an atomizing air supply line 38, and a paint supply line 40. The nozzle 34 allows a spray of paint S to be emitted from the coating gun toward the ball conveyor 12. The paint pressure air supply line 34 provides the pressure for driving the paint in the paint supply line 40. The atomizing air supply line 38 provides pressure at the nozzle 34 for atomizing the paint and directs it in the spray. The paint supply line 40 is a conduit for directing a supply of paint from a container (not shown) to the gun. One recommended coating gun is a Model MACH-1 HVLP spray gun manufactured by Binks of Glendale Heights, Ill.

The light source may be used to determine a golf ball position prior to painting, used to illuminate the spray as it leaves the gun, used to determine paint quality after a ball has been painted, or a combination thereof.

The light source may be a single or multiple light source and emitted in the form of visible radiation, non-visible sources of radiation, e.g., infrared, or electromagnetic radiation, by a laser or a led light source. In a preferred embodiment, the light source is a focused laser diode of nominal power output. A suitable laser light source is a 633 nm diode laser suitable for hazardous locations, such as an Intrinsically Safe transmitted Beam Series 9000 or equivalent manufactured by Allen-Bradley of Milwaukee, Wis. In another embodiment, the light source is a circularly or randomly polarized beam emitter, which requires the refractive index of the paint to be known to determine paint quality.

In one embodiment, the light source emits a light beam B in a point, line, fan, or 3-dimensional shape, such as a cone. It is recommended that the light source emits a light beam with a sufficient diffraction angle to illuminate the desired area. In some applications, the diffraction angle should equal the diffraction angle of the spray and also have a conical pattern to match the spray pattern.

The light source may also include a receiver to work as a team with the emitter. The emitters and receivers selected should have a response time between the emitter and receiver emitting the beam and receiving the beam that is short enough to generate information regarding the reflected beam prior to the ball traveling an appreciable distance, i.e., less than about 0.1 cm. An example of a suitable emitter and receiver commercially available, includes, but is not limited to, 42FB with Analog Output from Allen-Bradley Sensors of Milwaukee, Wis (response time of about 500 Ms)

The emitter is in electrical communication with a power source via a cable and the receiver is in electrical communication with a microprocessor via another cable. The microprocessor can compare signals from the emitter and receiver to predetermined stored data to determine, for example, if a ball received a coat of paint. The microprocessor can also be programmed to determine other spray qualities, such as the quality of the paint (i.e., density, coverage, etc.). When using multiple emitters and receivers, the signal from the emitter and receiver originating on an unpainted ball at Stage I differs as compared to the signal from the emitter and receiver originating on a painted ball at Stage III.

In addition, the light source may be adjustable or fixed with respect to the conveyor and guns. For example, when using a non-adjustable light source at Stage I, the light source may emit beam B that contacts the ball at Stage I prior to its being painted at Stage II. The beam B would serve to visually display information on the locations of the guns with respect to the ball. With this information, an operator may manually adjust the guns prior to spraying to assure that the balls are properly coated. Alternatively, this information may be used with an automated system and feedback control loop to further reduce the need for manual adjustment of the guns.

In alternative embodiments, adjusters (not shown) may be operatively connected to a light emitting source so that the golf ball locations and the spray locations can be substantially synchronized. For example, the adjuster may be in electrical communication with a microprocessor and operatively connected to the gun to adjust the gun orientation in all directions and angles, the pulse duration, the pressures of the pulses, the nozzle setting, e.g., orifice size, the distance from the ball, or various other coating spray properties. In one embodiment, if the microprocessor determines that the coating on the painted ball at Stage III is outside of a predetermined density range, the microprocessor can send a control signal to the adjuster to modify the spray of the gun so that it comes within the density range. The adjustment is preferably automatic.

In one embodiment, the adjustments may be made to the ball position at the various stages instead of directly to the guns. In another embodiment, the control system adjusts both the guns and the ball position based on the display information.

In yet another embodiment, light emitting sources may be positioned close to their related guns. The position of the light sources should prevent fouling of the light emitting sources by the guns. For example, positioning the light sources at the same distance from the balls as the guns are set, or positioning the a further distance away from the balls as compared to the guns, may help to prevent excess spray from the guns covering the light sources.

The ball conveyor 12 includes a horizontal ball plane P that extends through the equator of the ball and may include a belt 42 driven in a direction D by rollers (not shown) and a motor (not shown). A plurality of spindles 44, 46, and 48 may be mounted on the belt 42. The spindles are configured to include ball holders 50 and rotate the ball on axis R extending from the ball north pole to ball south pole. The axis of rotation of the ball described herein is for illustrative purposes only and one of ordinary skill in the art would appreciate that other orientations of the golf ball may be used without departing from the scope and spirit of the invention. For example, painting process may be configured such that the axis of rotation is normal to the parting line, commonly referred to as a poles horizontal orientation (PH) or so that the axis of rotation is orthogonal to PH, commonly referred to as a pole over pole orientation (PP).

The holders 50 support golf balls 52, 54, and 56 at Stages I, II, and III. Stage I, II, or III may be aligned with the light emitting sources, e.g., upstream, onstream, or downstream of the guns. In one embodiment, the conveyor includes a robot to pick a ball off the conveyor, analyze the paint thickness in the dimple areas, place the ball back onto the spindle and into the conveyor line, and adjust the paint spray accordingly.

Specific arrangements of the coating guns and light sources are illustrated in the non-limiting examples below. In all arrangements shown, various modifications can be made. For example, a single gun and light source with no automatic adjuster can be modified to have multiple guns and light sources with automatic adjustment capability to adjust for particular spray properties. When using more than one gun, each gun would include its own light source, e.g., a pair of laser beam emitters and receivers, and optionally, an adjuster.

In a first embodiment, as generally discussed above in FIGS. 2 and 3, the arrangement of the system is such that there are two coating guns and two light sources for monitoring the golf ball at Stage I prior to painting at Stage II. The light emitting sources 28 and 32 in this embodiment are laser light sources.

Figure 4:
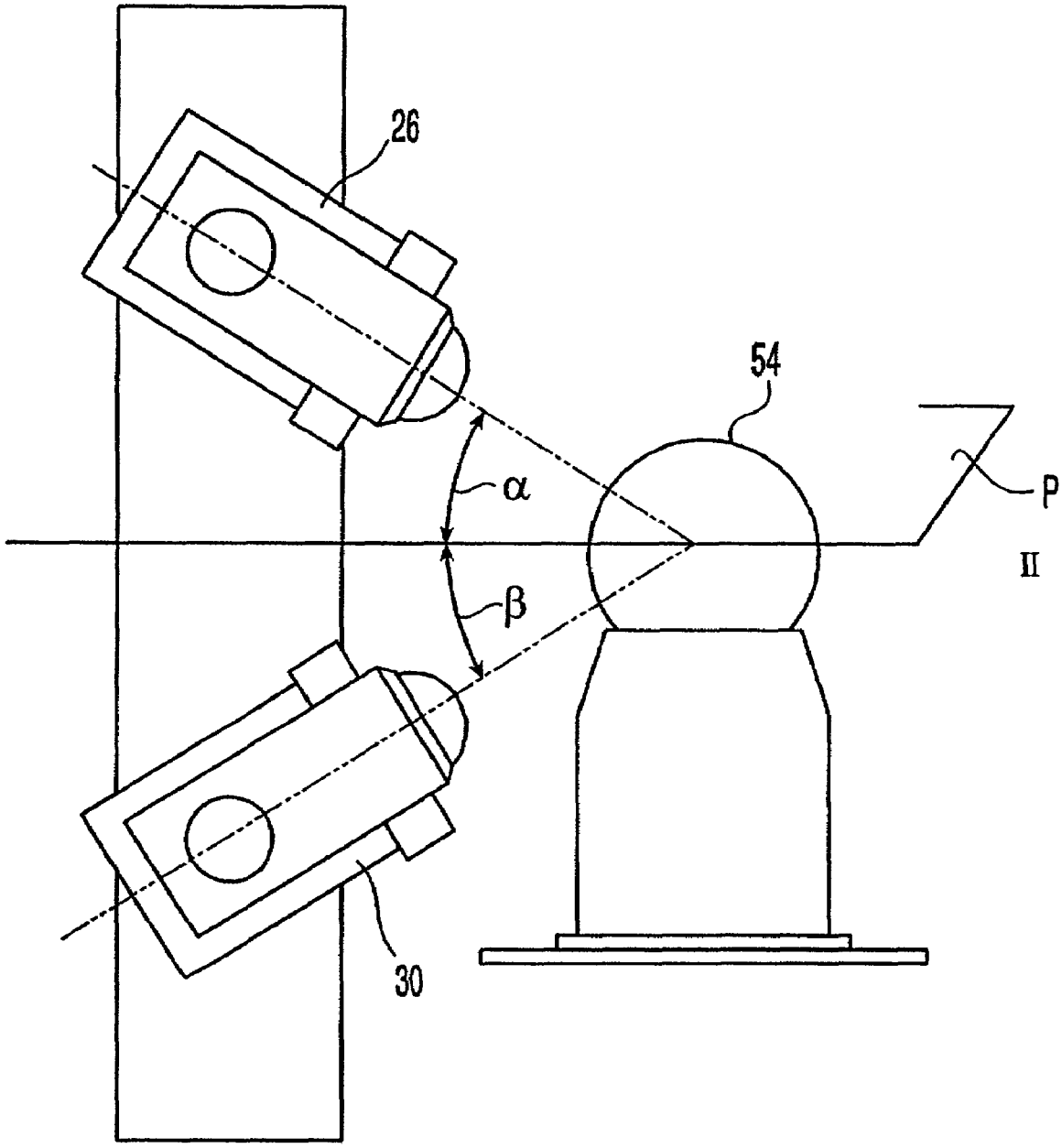
FIG. 4 is a partial, side view of the embodiment of the coating control system of FIG. 3.

The top coating gun 26 is arranged so that it is positioned at an angle $\alpha$ above the ball plane P, as shown in FIG. 4. The bottom coating gun 30 is arranged so that it is positioned at an angle $\beta$ below the ball plane P. Preferably, the angles $\alpha$ and $\beta$ are approximately 45°.

The distance between the center of the gun 26 and the center of the light emitting source 28 is designated L1, as shown in FIG. 3. The distance between the center of the ball 52 at Stage I and the center of the ball 54 at Stage II is designated L2. Preferably, the distances L1 and L2 are equal. More preferably, the distances L1 and L2 are about 2.5 inches to about 5.0 inches. The distance between the free end of the light source 28 and the nearest point of the outer surface of the ball 52 at Stage I is designated L3. The distance between the free end of the nozzle 34 of the gun 26 and the nearest point of the outer surface of the ball 54 at Stage II is designated L4. Preferably, the distances L3 and L4 are equal. In one embodiment, the distances L3 and L4 are from about 4 inches to about 18 inches. In another embodiment, the distances L3 and L4 are from about 6 inches to about 12 inches. The gun 30 and light emitting source 32 are similarly arranged with respect to balls 52 and 54.

The light emitting sources 28 and 32 and guns 26 and 30 may or may not be adjustable during use. During the painting process, the light sources 28 and 30 emit beam B that contacts the ball 52 at Stage I prior to its being painted at Stage II to visually display information on the locations of the guns 26 and 30 with respect to the balls 52, 54.

Figure 5:
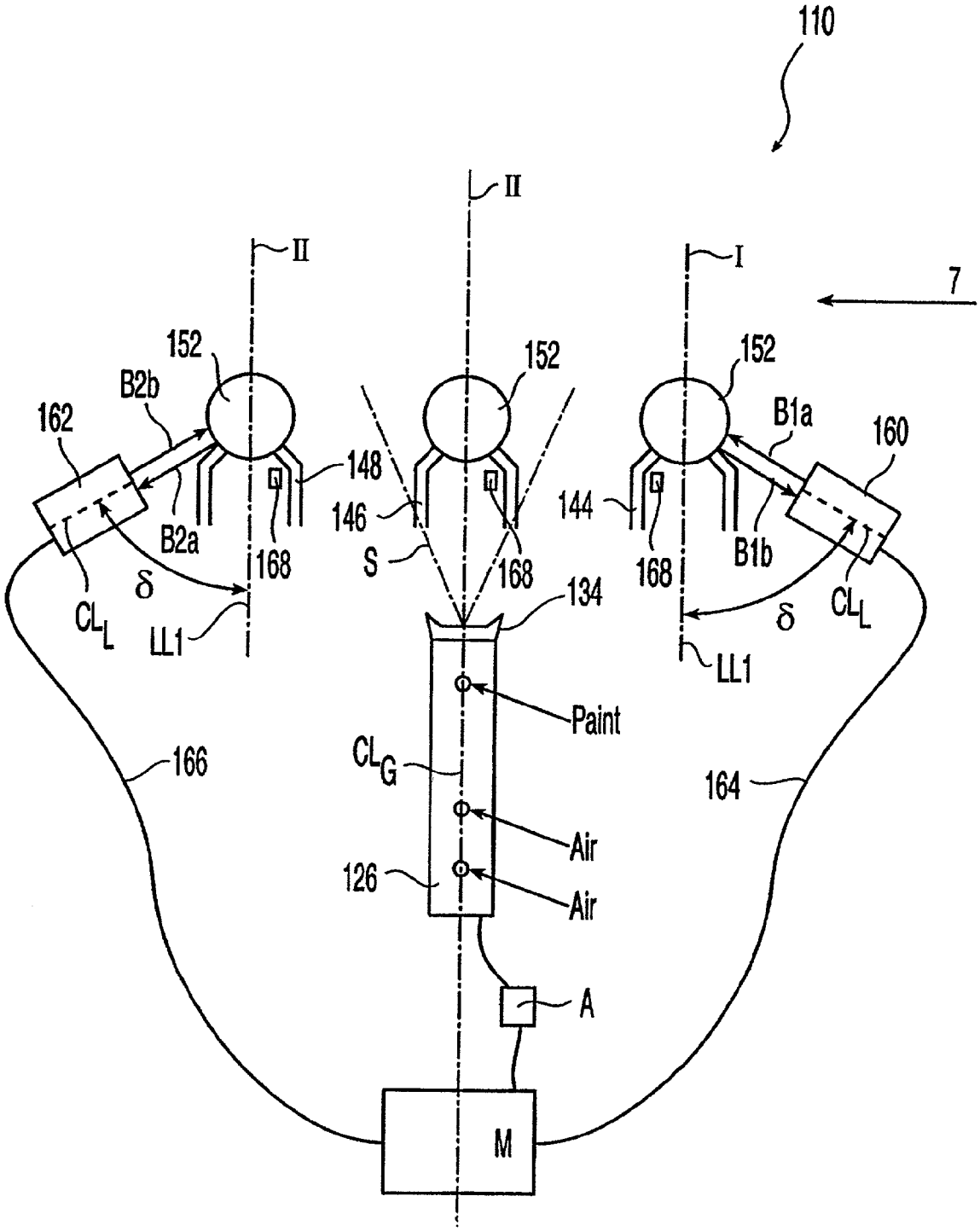
FIG. 5 is a schematic, perspective view of an embodiment of the coating control system of the present invention, showing golf balls in various positions during operation.

A second embodiment of the invention, shown in FIG. 5, provides an arrangement using at least one gun and multiple light sources to monitor the golf ball at Stage I, prior to painting, and again at Stage III, after painting, using an emitter, receiver, and a microprocessor. The system 110 includes at least one coating gun 126 and paint spray S is emitted through a nozzle 134 and directed at ball 152 when it is in Stage II.

The system 110 includes a first laser beam emitter and receiver 160, upstream of the paint Stage II and gun 126, and a second laser beam emitter and receiver 162, downstream of the paint Stage II and gun 126. The first laser beam emitter and receiver 160 is positioned to emit a laser beam B1*a* toward the ball 152 at Stage I, and receive the reflected beam B1*b* from the ball 152 at Stage I. The first laser beam emitter and receiver 160 converts the beam B1*b* to an analog output signal that is transmitted along cable 164 to a microprocessor M. The second laser beam emitter and receiver 162 is positioned to emit a laser beam B2*a* toward the ball 152 at Stage III, and receive the reflected beam B2*b* from the ball 152 at Stage III. The second laser beam emitter and receiver 162 converts the beam B2*b* it an analog output signal that is transmitted along cable 166 to microprocessor M. The signals are then compared to predetermined stored data to determine if the ball 152 received a coat of paint.

The angle between a center line $CL_L$ of the laser beam emitter and receivers 160 and 162 and a line LL1 is represented by the angle δ. The lines LL1 are is substantially parallel to the center line $CL_G$ of the gun 126. It is recommended that the angle δ be from 0° to about 45° to allow for gathering information regarding paint coverage.

The spindles 144, 146, and 148 that support the balls, optionally, include a positioning device 168. The positioning device 168 may allow the position of the ball and/or laser to be indexed to compare the beams. Recommended positioning devices include but are not limited to magnetic tabs, vision systems, or physical features.

There may also optionally be devices for indexing the position of the ball if the ball and spindle are rotating. For example, if the balls on the conveyor are spaced a certain distance apart, an eye may be used upstream (Stage I) of the spray gun to capture timing information as a ball passes. The information may be fed to a processor that controls the pulses of the spray guns so that adjustments can be made if for some reason the conveyor begins moving at a different rate.

Figure 6:
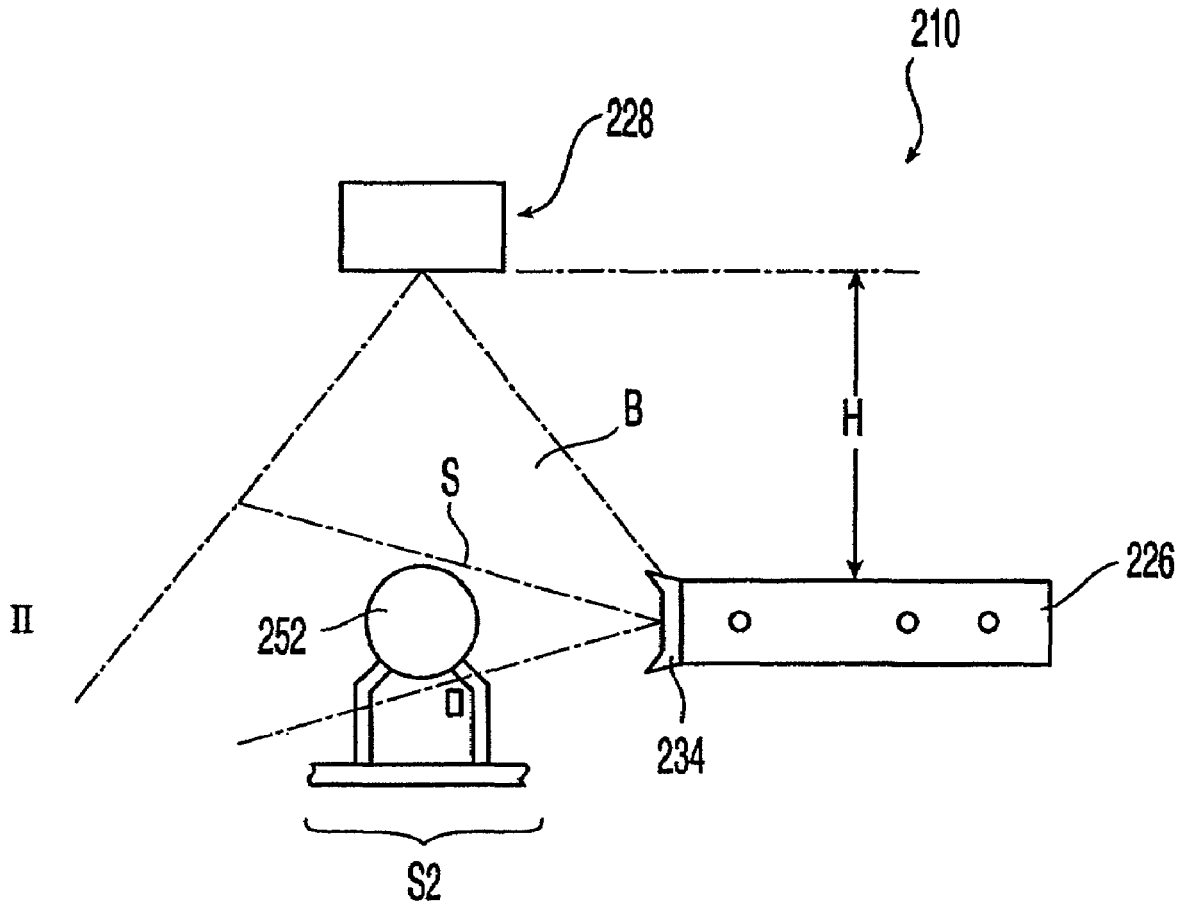
FIG. 6 is a schematic, elevational view of an embodiment of the coating control system of the present invention, showing a golf ball at the painting stage during operation.

A third embodiment of the coating control system 210 is shown in the arrangement of FIG. 6, wherein the light source illuminates the paint spray S emitted from nozzle 234 of the at least one coating gun 226.

A light emitting source 228 is disposed a predetermined height H above the gun 226 and emits a light beam B in a pattern. The height H should be set so that the beam B intersects and illuminates substantially the entire spray S with in a spray zone SZ containing the ball 252 at Stage II. During operation, the illumination of the spray S by the beam B allows an operator to clearly see the spray S and the operator can assess the spray pattern and make necessary adjustments to the system 210. An adjuster can also be operatively connected to the light emitting source 228 so that the spray location B and the ball location can be substantially synchronized.

Figure 7:
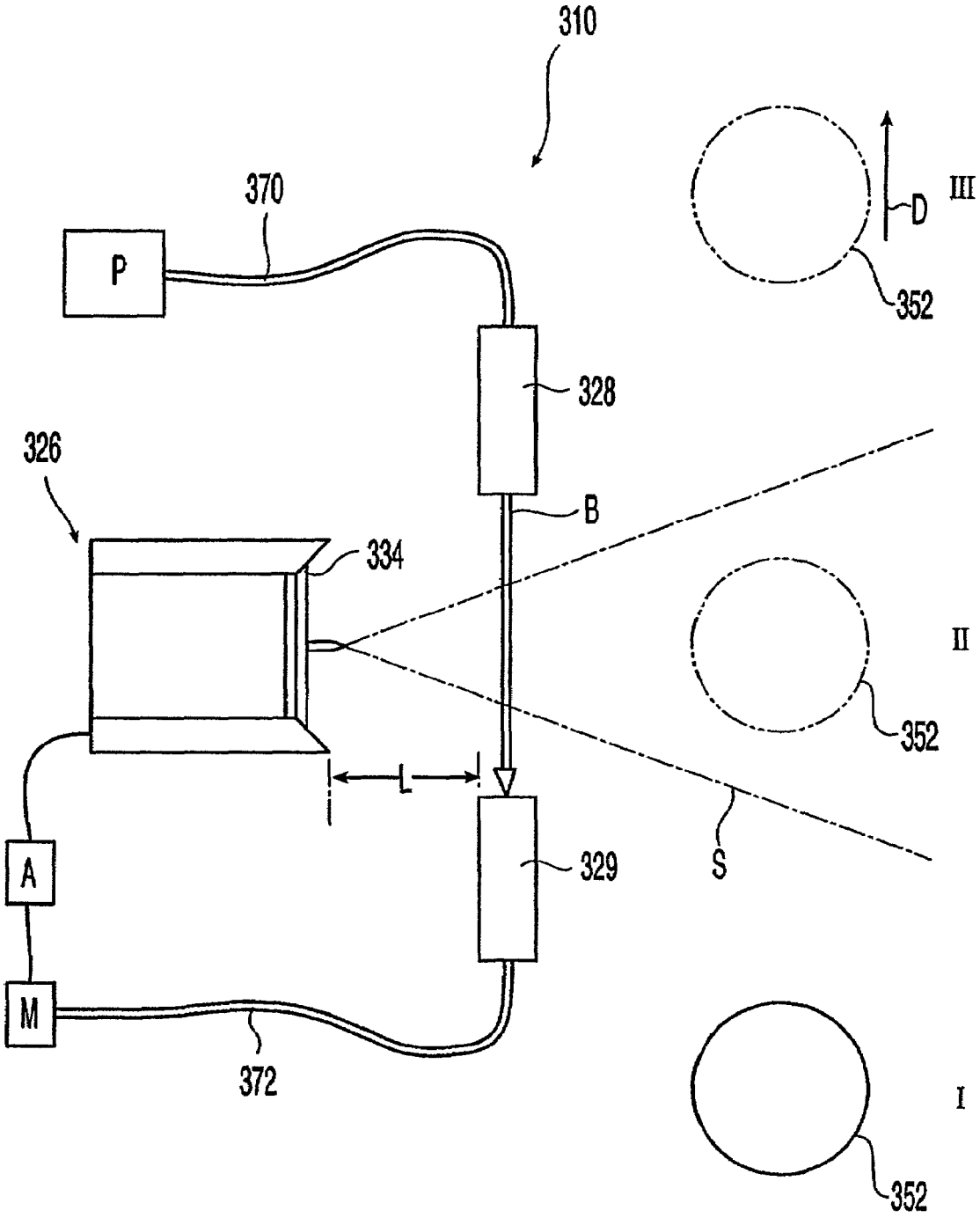
FIG. 7 is a schematic, top view of an embodiment of the coating control system of the present invention, showing golf balls in various positions during operation.

In a fourth embodiment, shown in FIG. 7, the coating control system includes a light source directed through the spray to determine at least one spray property. The system 310 includes at least one coating gun 326 having a nozzle 334 for emitting a paint spray S at ball 352 when it is in Stage II.

The system 310 includes a light emitting source 328 and light receiver 329. The light emitting source 328 and receiver 329 are arranged so that a beam B emitted by the source 328 is directed through the spray S and received by the receiver 329. The beam B spaced a distance L from the nozzle 334. It is recommended that the distance L be from about 2 inches to about 8 inches. The source 328 is in electrical communication with a power source P via cable 370. The receiver 329 is in electrical communication with a microprocessor M via cable 372.

The system 310 may further include an adjuster A, in electrical communication with the microprocessor M and coupled to the gun 326, to alter a spray property. The system 310 can be modified to include two guns, each gun would include a light emitting source and receiver, an optionally an adjuster. In another embodiment, more than one set of light emitting sources and receivers can be used at different lengths L to generate more accurate data.

Figure 8:
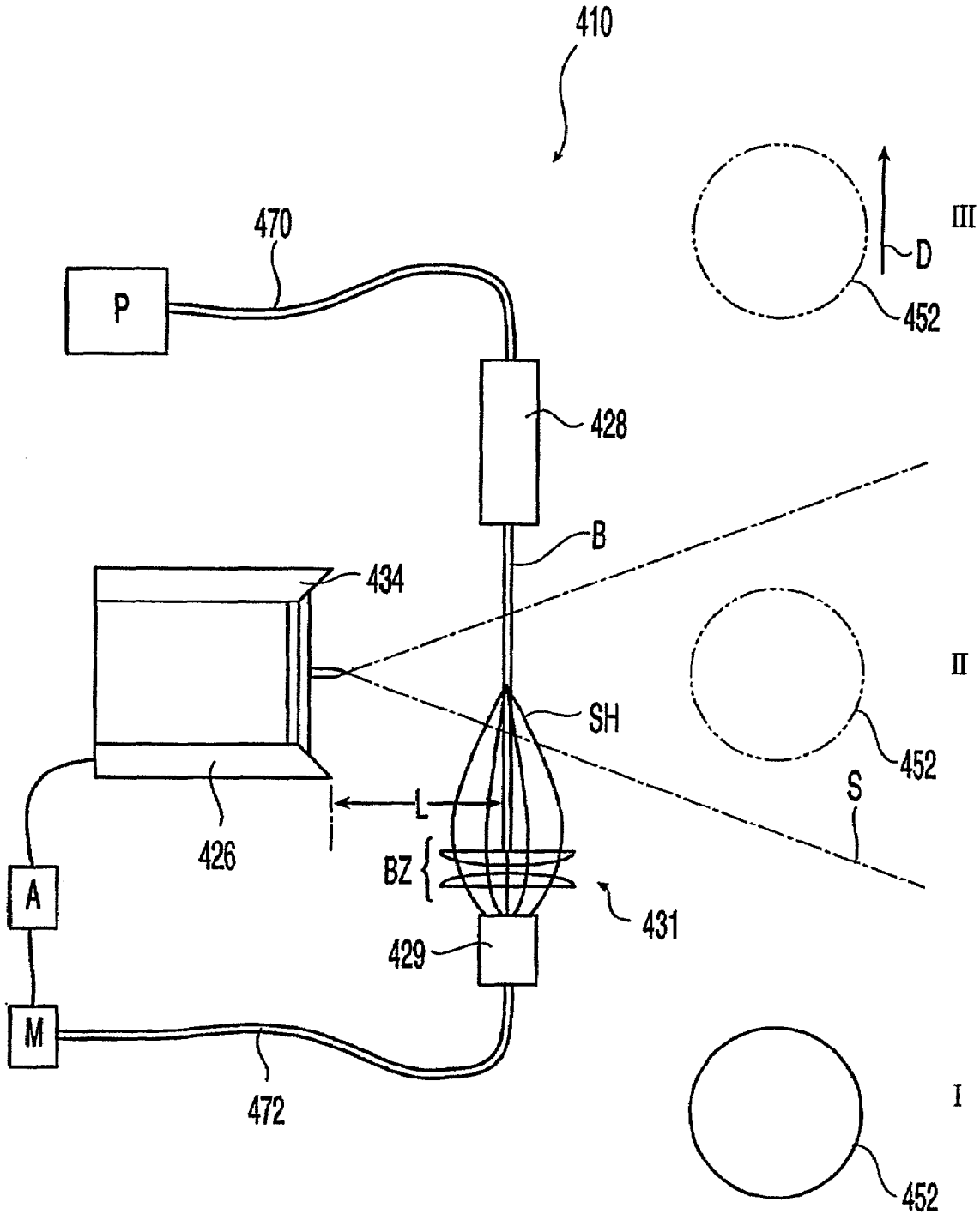
FIG. 8 is a schematic, top view of an embodiment of the coating control system of the present invention, showing golf balls in various positions during operation.

FIG. 8 illustrates a fifth embodiment of the coating control system wherein the light source is directed through the spray and optics are used to focused the scattered light due to particle size. The system 410 is similar to 310 discussed above, and may further include multiple guns, light sources, and adjusters.

The beam B will be affected by the paint particles as it travels through the spray S, and light will be scattered, as indicated by SH, in a manner that corresponds to particle size. Focusing optics 431, such as a compound lens system, are disposed between the light emitting source 428 and the receiver 429 so that they focus the scattered light SH in the beam zone BZ. A suitable light source 428 and receiver 429 is an SA1C-FK fiber optic analog photoelectric sensor from IDEC Sensors of Sunnyvale, Calif.

The receiver 429 emits an output signal to be received by the microprocessor M. The microprocessor M uses this signal to identify at least one coating spray property. The microprocessor M can then send a control signal to an adjuster A to adjust a spray property of the gun 426, e.g., atomization parameters of the spray guns.

Figure 9:
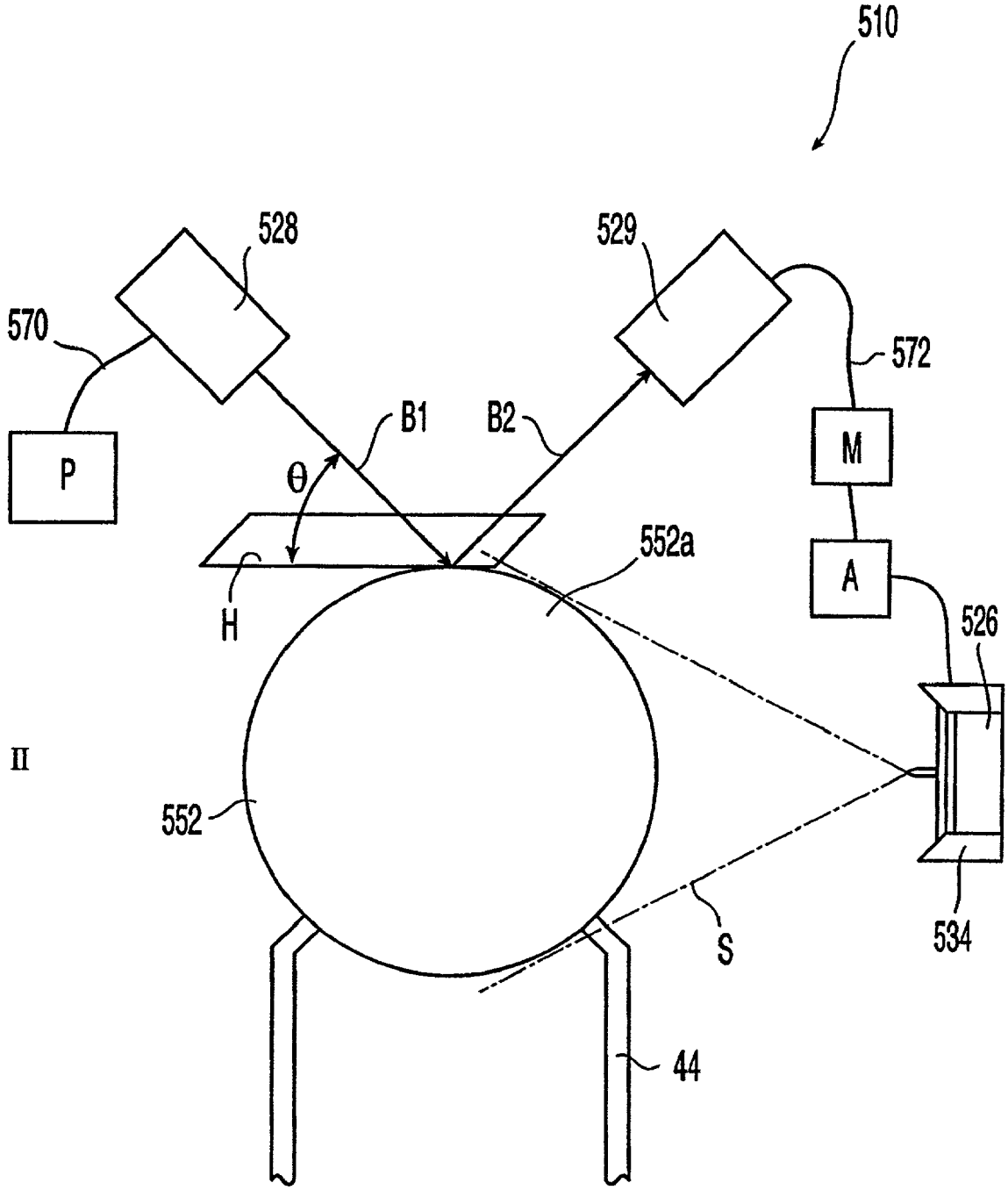
FIG. 9 is a schematic, elevational view of an embodiment of the coating control system of the present invention, showing a golf ball at the painting stage during operation.

A sixth embodiment of the coating control system is shown in the arrangement of FIG. 9, wherein the light emitting source is a circularly or randomly polarized beam emitter directed on the ball while in Stage II. The system 510 includes at least one coating gun 526, a light emitting source 528, and a light receiver 529. The system may also include multiple guns, adjusters, and multiple light sources.

The light emitting source 528 and receiver 529 are arranged so that a light beam B1 emitted by the source 528 is directed at an angle θ with a horizontal plane at the outer surface 552*a* of the ball so that a reflected beam B2 is linearly polarized. This angle θ is known as Brewster's Angle, i.e., the angle at which a circularly or randomly polarized source of light incident on a reflective surface becomes linearly polarized in the plane of the reflective surface. This angle depends on the index of refraction of the reflective surface, and thus, the refractive index of the paint will need to be determined prior to operation. The index can vary as the paint dries.

The microprocessor M uses a signal from receiver 529 to identify at least one coating spray property. For example, the polarity of the reflected beam may be used to indicate whether the ball has received paint. The microprocessor M can then send a control signal to the adjuster A to adjust the coating spray property of the gun 526.

Suitable circularly or randomly polarized beam emitters and receivers commercially available, include, but are not limited to, Edmund Scientific of Barrington, N.J. and Allen-Bradley of Milwaukee, Wis. Circularly polarized beam emitters propagate light in spiral waves, but non-polarized beam emitters are also contemplated by the present invention, thus allowing light propagation at any angle.

Figure 10:
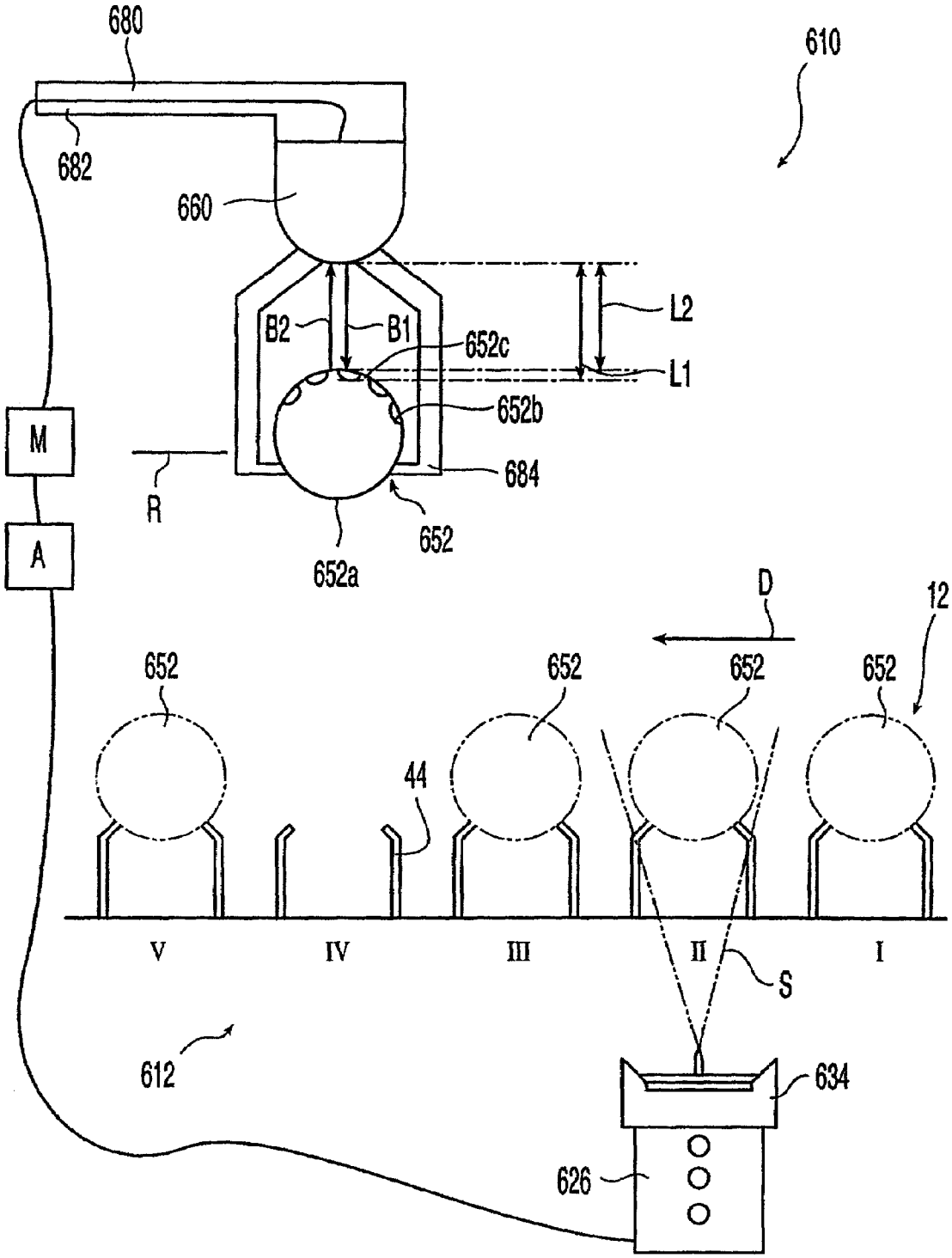
FIG. 10 is a schematic, elevational view of an embodiment of the coating control system of the present invention, showing golf balls at various positions during operation.

A seventh embodiment of the coating control system of the invention is shown in FIG. 10. This arrangement provides a way to monitor the paint thickness in the depressions, or dimples, of a traditional golf ball cover.

The system 610 includes at least one coating gun 626, a light source 660, i.e., an emitter and receiver, at Stage IV, after painting. A hollow rigid mount member 680 above the conveyor 12 supports the light source 660. The light source 660 includes a wire 682 extending through the interior of the rigid mount member 680 and for electrically connecting the light source 660 to a microprocessor M. Multiple guns, light sources, and adjusters may also be employed in this arrangement.

The system 610 further includes a robot gripper 684 coupled to the light source 660 and movable between a raised position (as shown) and a lowered position where the ball 652 at Stage IV in the gripper 684 is in contact with the spindle 44. Thus, the gripper 684 holds the ball and moves it vertically between a position in contact with the spindle and the position adjacent the light source 660.

The light source 660 emits a laser beam B1 toward the ball 652, and receives the reflected beam B2 from the ball 652. The light source 660 converts the beam B2 into an analog output signal that is transmitted along cable 684 to microprocessor M. For illustrative purposes, the ball 652 includes an outer surface 652*a* with depressions, or dimples, 652*b*. The outer surface between the dimples 652*b* is a land or fret area 652*c*.

The length L1 is the distance from the light source 660 to the bottom of dimple 652*b*. The length L2 is the distance from the light source 660 to the fret area 652*c*. The beam B1 is controlled to orient ball 652 to dimple 652*b* by rotating the ball with the robot gripper 684 about axis R to maximize length L1. Then, the film thickness reading is taken using the analog signal generated by beam B2.

The beam B1 can also be controlled to orient ball 652 to fret area 652*c* by rotating the ball with the robot gripper 684 about axis R to minimize L2. Then the film thickness is taken using the analog signal generated by beam B2.

It is recommended that ball rotation be between about 1° and about 5°. It is also recommended that this rotation be in only one direction. The present invention is not limited to this operation method and the rotation can be more or less than specified and in more than one direction.

The microprocessor M compares the output signals from source 660 to predetermined stored data to determine the thickness of the paint. The light source may be selected such that the response time between the emitting the beam onto $ball_1$, receiving the beam back, processing the information, and adjusting at least one spray property is predetermined so that $ball_{1+x}$ upstream of $ball_1$ on the conveyor receives the benefits of the adjustments. In one embodiment, the response time is such that x is less than 100, so that $ball_{100}$ and balls further upstream are affected by the adjustment in at least one spray property. In another embodiment, the response time corresponds to $x \leqq 49$ so that $ball_{50}$ and those upstream are affected by the adjustment. In yet another embodiment, the response time corresponds to $x \leqq 29$ so that $ball_{30}$ and those balls upstream of $ball_{30}$ receive the benefits of the spray property adjustment.

In one embodiment, the response time is optimized so that the next ball on the conveyor ($ball_2$) is affected by the adjustment in at least one spray property. In another embodiment, the response time is short enough to allow for almost instantaneous adjustment so that the ball being painted (at Stage II) may benefit from the spray property adjustment.

The response time may vary depending on the embodiments described above. In one embodiment, the response time is less than about 15 minutes, preferably less than about 5 minutes. In another embodiment, the response time is less than about 30 seconds. In yet another embodiment, the response time is less than about 1 second. In still another embodiment, the response time is nanoseconds.

While it is apparent that the illustrative embodiments of the invention disclosed herein fulfill the objectives stated above, it is appreciated that numerous modifications and other embodiments may be devised by those skilled in the art. For example, the control system of the invention may be used to monitor the intensity of the spray pattern. Also, while laser light sources are described herein, one of ordinary skill in the art would appreciate that the use of other light sources would not depart from the scope and spirit of the present invention. Moreover, while the embodiments described herein generally describe the coating control system for use with a golf ball, other spherical objects, such as tennis balls, croquet balls, racquetball balls, pool balls, and the like are also contemplated for use with the present invention. In addition, the features of one embodiment can be used with the features of another embodiment. Therefore, it will be understood that the appended claims are intended to cover all such modifications and embodiments which would come within the spirit and scope of the present invention.

What is claimed is:

1. A golf ball coating control system, comprising:

a first coating gun for emitting a spray onto a golf ball at a thickness;

a first light source for identifying a spray location and at least one spray property comprising a first emitter capable of sending a first beam of light toward the golf ball and a first receiver capable of receiving reflected light beams from the golf ball, and wherein the at least one spray property is a coating spray density, an atomization parameter, a coating spray distribution, a coating spray thickness, polarization, or a combination thereof;

a tracking device for identifying a golf ball position;

a second light source for monitoring the thickness comprising a second emitter capable of sending a second beam of light toward the golf ball and a second receiver capable of receiving reflected light beams from the golf ball;

an adjuster operatively connected to the first coating gun, first receiver, and second receiver to enable substantial synchronization of the golf ball position and the spray location and alteration of the at least one spray property.

2. The golf ball coating control system of claim 1, wherein the first beam of light represents the spray.

3. The golf ball coating control system of claim 1, wherein the first light source is disposed at a first position and the coating gun is disposed at a second position downstream of the first position.

4. The golf ball coating control system of claim 3, wherein the golf ball moves from the first position to the second position during operation of the system.

5. The golf ball coating control system of claim 1, wherein the first light source is upstream of the coating gun and the second light source is downstream of the coating gun.

6. The golf ball coating control system of claim 1, wherein the adjuster has a response time of less than about 30 seconds.

7. The golf ball coating control system of claim 6, wherein the response time is less than about 1 second.

8. The golf ball coating control system of claim 1, wherein the first and second receivers each generate at least one analog signal indicative of at least one spray property.

9. The golf ball coating control system of claim 8, wherein the at least one analog signal is sent to the adjuster, and wherein the adjuster uses the at least one analog signal to control the spray emitted by the gun.

10. The golf ball coating control system of claim 1, wherein the first light source is located above the gun, and wherein the first beam of light illuminates the spray to make the spray location visible.

11. The golf ball coating control system of claim 1, wherein the first light source comprises a laser or a led light source.

12. The golf ball coating control system of claim 1, further comprising a second coating gun associated with a third light source.

13. The golf ball coating control system of claim 1, wherein the adjuster is automatic.

14. A golf ball coating control system comprising:

a device for emitting a coating spray onto at least one golf ball at a thickness, wherein the coating spray has a coating spray pattern;

a first light source for identifying the coating spray pattern and at least one other coating spray property, wherein the first light source comprises a first emitter and a first receiver;

a second light source for monitoring the thickness of the coating spray on the at least one golf ball, wherein the second light source comprises a second emitter and a second receiver; and an adjuster, wherein the adjuster is operatively connected to the device, the first receiver, and the second receiver to enable adjustment of the coating spray pattern, the thickness of the coating spray, and the at least one other coating spray property.

15. The golf ball coating control system of claim 14, wherein the at least one other coating spray property is at least one of a coating spray density, an atomization parameter, a coating spray distribution, or polarization.

16. The golf ball coating control system of claim 15, wherein the atomization parameter comprises spray particle size.

17. The golf ball coating control system of claim 14, wherein the device is at least one coating gun.

18. The golf ball coating control system of claim 14, wherein the first emitter discharges a laser beam that intersects the coating spray.

19. The golf ball coating control system of claim 18, wherein the first receiver receives the laser beam after the laser beam intersects the coating spray.

20. The golf ball coating control system of claim 19, wherein the adjuster receives at least one signal from the first receiver indicative of the coating spray pattern and the at least one other coating spray property.

21. The golf ball coating control system of claim 19, further comprising focusing optics disposed between the first emitter and the first receiver.

22. The golf ball coating control system of claim 19, wherein the first emitter is a polarized beam emitter, and wherein the first emitter and the first receiver are positioned to enable linear polarization of the laser beam received by the first receiver.

23. The golf ball coating control system of claim 18, wherein the first emitter is positioned above the at least one golf ball and the first receiver is positioned above the at least one golf ball to receive the laser beam from the first emitter.

24. The golf ball coating control system of claim 14, further comprising a microprocessor in communication with the adjuster and the first and second light sources.

25. The golf ball coating control system of claim 14, wherein the first light source and the device are in an operative mode at the same time.

26. A coating control system for use on a golf ball comprising:

a coating gun for selectively emitting a spray in a first pattern onto the golf ball at a thickness;

a first light source for emitting light in a second pattern, wherein the first and second patterns contact the golf ball, and wherein the first light source identifies the first pattern and at least one other coating spray property;

a second light source for measuring the thickness; and an adjuster in communication with the coating gun, first light source, and second light source to enable alteration of the first pattern and the at least one other coating spray property within less than about 30 seconds.

27. The coating control system of claim 26, wherein the emission of the spray and light occur simultaneously.

28. The coating control system of claim 27, wherein the emitted light is a laser beam received by a receiver, and wherein the receiver generates a signal indicative of the second pattern.

29. The coating control system of claim 28, wherein the adjuster alters the first pattern to be substantially the same as the second pattern.

30. The coating control system of claim 26, wherein the emission of light occurs prior to the emission of the spray.

31. The coating control system of claim 30, wherein the emitted light is a laser beam received by a receiver, and wherein the receiver generates a signal indicative of the second pattern.

32. The coating control system of claim 26, wherein the at least one other coating spray property is at least one of a coating spray density, an atomization parameter, a coating spray distribution, or polarization.

* * * * *